US006339938B1

(12) United States Patent
De Bussy et al.

(10) Patent No.: US 6,339,938 B1
(45) Date of Patent: Jan. 22, 2002

(54) APPARATUS AND PROCESS FOR SEPARATING AIR BY CRYOGENIC DISTILLATION

(75) Inventors: Francois De Bussy, Paris; Frederic Judas, Chatenay-Malabry, both of (FR)

(73) Assignee: L'Air Liquide, Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/599,407

(22) Filed: Jun. 22, 2000

(30) Foreign Application Priority Data

Jun. 22, 1999 (FR) ..... 99 07931

(51) Int. Cl.[7] ..... F25J 3/00
(52) U.S. Cl. ..... 62/643
(58) Field of Search ..... 62/643, 646, 647

(56) References Cited

U.S. PATENT DOCUMENTS

| | | | |
|---|---|---|---|
| 5,291,737 | A | 3/1994 | Camberlein et al. |
| 5,582,035 | A | 12/1996 | Rathbone et al. |
| 5,765,396 | A | 6/1998 | Bonaquist |

FOREIGN PATENT DOCUMENTS

| | | | |
|---|---|---|---|
| EP | 0381319 | A1 | 8/1990 |
| EP | 0556516 | A2 | 8/1993 |

*Primary Examiner*—William Doerrler
*Assistant Examiner*—Malik N. Drake
(74) *Attorney, Agent, or Firm*—Young & Thompson

(57) ABSTRACT

In an air separation apparatus comprising at least two columns (104, 105) and optionally a mixing column (107), a liquid containing between 22 and 70 mol % oxygen is vaporized in a reboiler/condenser (109) against a stream of air (86) which condenses therein at least partially. The stream of at least partially condensed air is sent to at least one column (104, 105, 107) of the column system.

19 Claims, 2 Drawing Sheets

APPARATUS AND PROCESS FOR SEPARATING AIR BY CRYOGENIC DISTILLATION

FIELD OF THE INVENTION

The invention proposed here relates to the field of distillation of the gases in air and in particular to an apparatus and a process for separating air by cryogenic distillation. It makes it possible to improve the oxygen extraction efficiency and thus the energy performance in distillation plants which do not ordinarily comprise feeding liquefied air into the columns and the refrigeration produced wherein is provided by air expansion (oil-brake, generating or self-boosted turbine). This invention, when it is incorporated in an air separation unit, results in savings of 3.5% (cf. the case presented below) in terms of energy for separating the oxygen.

This constitutes a major advance in a field already well explored, in which savings greater than 1% are welcome, especially in countries where the cost of energy is high.

BACKGROUND OF THE INVENTION

The basic distillation processes in which the invention can be used are processes which ordinarily do not include feeding liquid air into the distillation columns.

These basic processes are processes for separating the gases in air, by compressing air, precooling compressed air, purifying air, cooling air in a main exchanger, separating air in a distillation column comprising at least one medium-pressure column and one low-pressure column and subcooling the liquids refluxing from the medium-pressure column to the low-pressure column.

Among the plants in question, we may mention:

A double column (single cycle) producing low-pressure oxygen coming from the cold box.

One particular case: production, using MP/LP column, of pressurized impure oxygen (utilization of the waste gas). In this case, the loss of efficiency due to the reduction in reflux (distillation more difficult in the MP column) makes itself cruelly felt. This invention will make it possible to improve the efficiency in this case;

Double column with a mixing column.

This type of plant, producing pressurized oxygen (for example at 5 bar) directly, by putting only the minimum amount of energy into the apparatus (compared with a pumped plant), achieved, for a 99% $O_2$ efficiency, a production of 1.1% of MP nitrogen (one possible characterization of the medium-pressure nitrogen-gas rectification overcapacity) (blowing turbine, 2000 t/d, 95% oxygen and 5 bar, large number of trays).

For smaller sizes of apparatus, the 99% efficiency can no longer be achieved. Here again, a gain in efficiency is obtained with this invention.

In both these plants, we are thus going to be able to increase the oxygen efficiencies (or the amount of medium-pressure nitrogen produced, if the oxygen efficiency is already high) and thus to improve the energy performance of the air separation unit. This results, of course, in a considerable amount of money being saved.

It is known from EP-A-0,556,516 to condense a stream of air coming from a blowing turbine in a reboiler/condenser, either at an intermediate level of the low-pressure column, or fed with a liquid coming from the medium-pressure column or from the low-pressure column. The air thus liquefied is sent to the low-pressure column, but it does not constitute the only supply of liquid air to the apparatus since air is also liquefied in the condenser in the bottom of the apparatus and sent to both columns of the double column.

EP-A-0,381,319 describes a column system in which a stream of air vaporizes against a stream containing 95 vol % oxygen.

U.S. Pat. No. 5,765,396 relates to a conventional pumped process in which a stream of air condenses against liquid containing between 98 and 100 mol %.

U.S. Pat. Nos. 5,582,035 and 5,291,737 disclose air separation processes with a mixing column, in which all the air re-enters the columns in gas form.

U.S. Pat. No. 3,754,406 proposes to vaporize rich liquid from the medium-pressure column of a double column against medium-pressure gaseous nitrogen. Air is liquefied by heat exchange with pumped liquid oxygen sent to the low-pressure column.

SUMMARY OF THE INVENTION

One object of the invention is to provide an air separation apparatus comprising a column system comprising at least one double column comprising a medium-pressure column and a low-pressure column which are thermally linked to each other by a first reboiler/condenser where tho gas at the top of the medium-pressure column condenses, means for sending compressed and purified air to a heat exchanger where it cools, means for sending cooled air to the medium-pressure column in gas form, means for sending an oxygen-enriched fluid from the medium-pressure column to the low-pressure column where it is separated by cryogenic distillation, means for sending a nitrogen-enriched fluid from the medium-pressure column to the low-pressure column, means for withdrawing a nitrogen-rich fluid and an oxygen-rich fluid from the low-pressure column, a second reboiler/condenser, means for sending air to the second reboiler/condenser where it condenses at least partially, and means for sending the at least partially condensed air to the low-pressure column, means for sending a liquid from the low-pressure column or from the medium-pressure column or from another column of the column system to the second reboiler/condenser, characterized in that the liquid sent to the second reboiler/condenser contains between 22 and 70 mol % oxygen and in that the at least partially condensed air sent to the column system comprises the only stream of liquefied air sent to the column system.

Optionally, the at least partially condensed air sent to the low-pressure column constitutes the only stream of liquefied air sent to the column system.

Preferably, the apparatus includes means for expanding the air with production of work before sending it to the second reboiler/condenser and/or means for cooling the air to its dew point before sending it to the second reboiler/condenser.

Preferably, the liquid sent to the second reboiler/condenser comes from the medium-pressure column, from the bottom of the latter or from a point located at most five theoretical trays above the bottom of the latter.

The at least partially condensed air may be sent to the low-pressure column and/or to the medium-pressure column and/or to another column of the column system.

Preferably, the apparatus includes a mixing column fed at the top with an oxygen-rich liquid coming from the low-pressure column and fed at the bottom with a gas more volatile than the oxygen-rich liquid.

Thus, there may be means for sending a portion or the liquid from the bottom of the medium-pressure column directly to the low-pressure column at a first level and another portion of the liquid from the bottom of the medium-pressure column to the second reboiler/condenser.

Preferably, the liquid vaporizes in the second reboiler/condenser and the apparatus may include means for sending the vaporized liquid to the low-pressure column at a level below the first level.

There may be means for withdrawing a nitrogen-rich gas from the top of the medium-pressure column.

Preferably, the low-pressure column does not have a top condenser.

Another object of the invention is to provide a process for separating air by cryogenic distillation in an apparatus comprising at least one double column with a medium-pressure column and a low-pressure column which are thermally linked to each other by a first reboiler/condenser, in which process a stream of purified, compressed and cooled air is sent to the medium-pressure column, in gas form, an oxygen-enriched fluid is sent from the medium-pressure column to the low-pressure column, where it is separated by cryogenic distillation, a nitrogen-enriched fluid is sent from the medium-pressure column to the low-pressure column, an oxygen-rich fluid and a nitrogen-rich fluid are withdrawn from the low-pressure column, a second stream of purified, compressed and cooled air is sent to a second reboiler/condenser where it condenses, at least partially, by heat exchange with a liquid coming from the medium-pressure column or from the low-pressure column or from another column of the column system and the at least partially condensed air is sent to the low-pressure column, characterized in that the liquid sent to the second reboiler/condenser contains between 22 and 70 mol % oxygen, optionally between 22 and 35 mol % oxygen, and the air liquefied in the second reboiler/condenser constitutes the only stream of liquefied air sent to the column system.

According to other optional aspects:

- the second stream is expanded in a turbine before at least one portion thereof is sent to the second reboiler/condenser;
- an oxygen-rich liquid is sent from the low-pressure column to the top of a mixing column and a gas more volatile than the oxygen-rich liquid, for example air, is sent to the bottom of the mixing column;
- nitrogen is withdrawn from the top of the medium-pressure column;
- the liquid sent to the second reboiler/condenser may come from a/the mixing column.

Gaseous air leaving a turbine may be condensed in the second reboiler/condenser against a portion of the rich liquid leaving the MP column or of an oxygen-rich liquid removed from one region of the LP column. This fraction of the rich liquid vaporizes at the pressure of the LP column and is then introduced in the LP column into a section below the main rich-liquid feed. As regards the liquefied air, this is introduced, for example, into the LP column at an intermediate section between the rich liquid and the depleted liquid.

The key advantage of adding this second reboiler/condenser is that it creates, by distilling a portion of the rich liquid, liquid air which provides the reflux in the upper section of the LP column by complementing the depleted liquid. The LP distillation diagram is thus improved (cf. MacCabe diagrams). Even if there is less air feeding the MP column because of an increase in the blowing rate (lower expansion rate), the overall effect goes towards improving the rectification capacity.

BRIEF DESCRIPTION OF THE DRAWINGS

The invention will now be described in greater detail with reference to the appended figures.

DETAILED DESCRIPTION OF THE INVENTION

Figure 1:
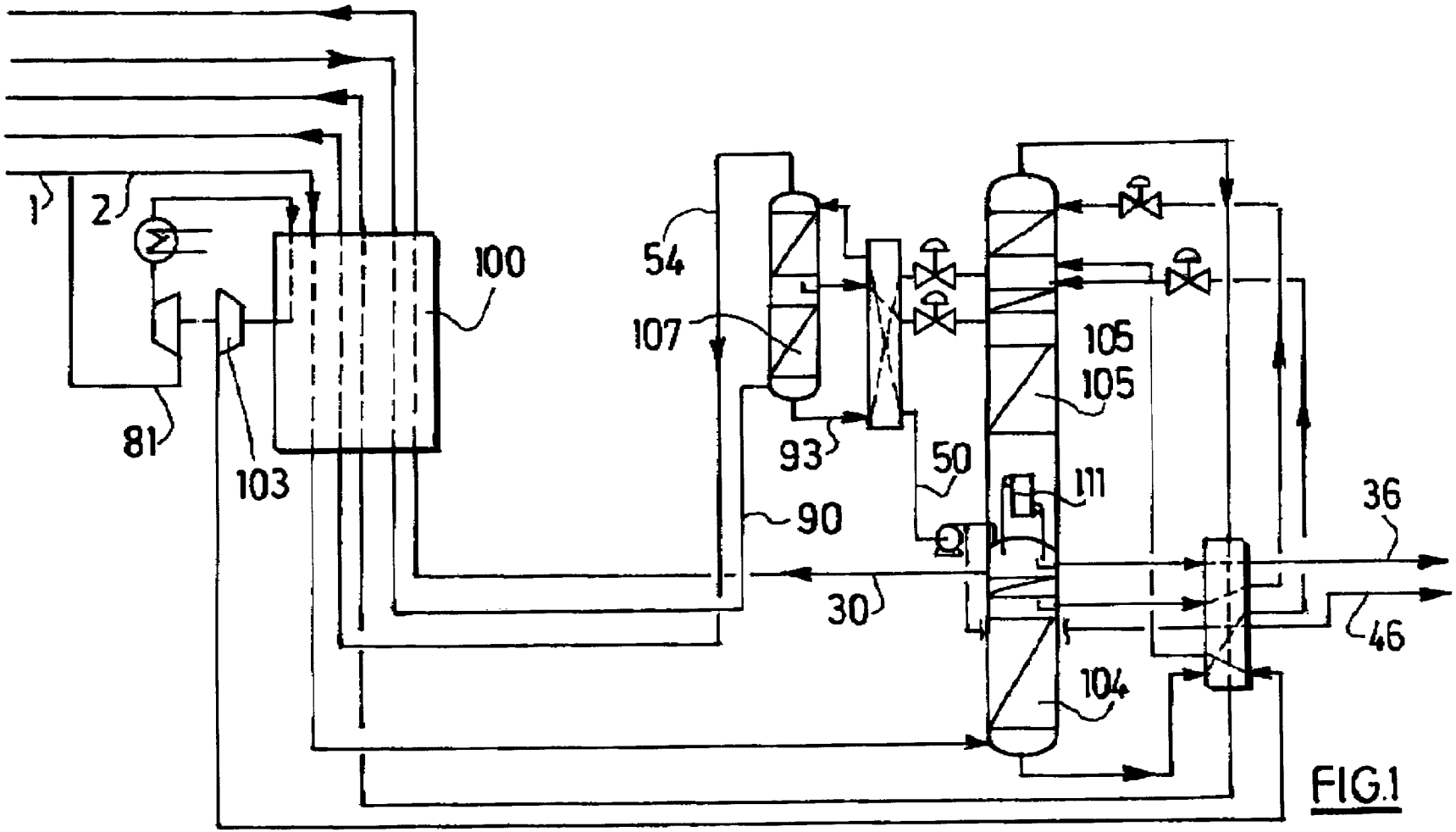
FIG. 1 is a diagram of an apparatus according to the prior art.

In FIG. 1, a stream of air at 5.25 bar is split into two in order to form a stream 2 of 188,135 $Nm^3/h$ and a stream 81 of 12,900 $Nm^3/h$. The stream 2 is cooled in the exchanger 100 and sent to the bottom of the medium-pressure column 104. The stream 81 is pressurized to 8.7 bar, partially cooled in the exchanger 100 and expanded in the blowing turbine 103 before being sent to the low-pressure column 105.

The medium-pressure column 104 operates at 5 bar and the low-pressure column 105 operates at 1.3 bar. The columns are thermally linked by a first reboiler/condenser 111.

The apparatus produces liquid oxygen 46 and liquid nitrogen 36. The rich liquid from the medium-pressure column 104 is sent to the low-pressure column 105 above the blowing air level.

Liquid nitrogen 50 withdrawn from the bottom of the low-pressure column is sent to the top of the mixing column 107 after being pumped at 5.1 bar. A third stream of air 90 is fully cooled in the exchanger 100 and is fed into the bottom of the mixing column. A bottom liquid 93 and, optionally, at least one intermediate liquid which are withdrawn from the mixing column are sent to the low-pressure column, while a stream of oxygen containing 54 to 95 mol % oxygen is withdrawn from the top of the mixing column and warmed in the exchanger 100 with 3100 $Nm^3/h$ of medium-pressure nitrogen and the low-pressure waste.

Figure 2:
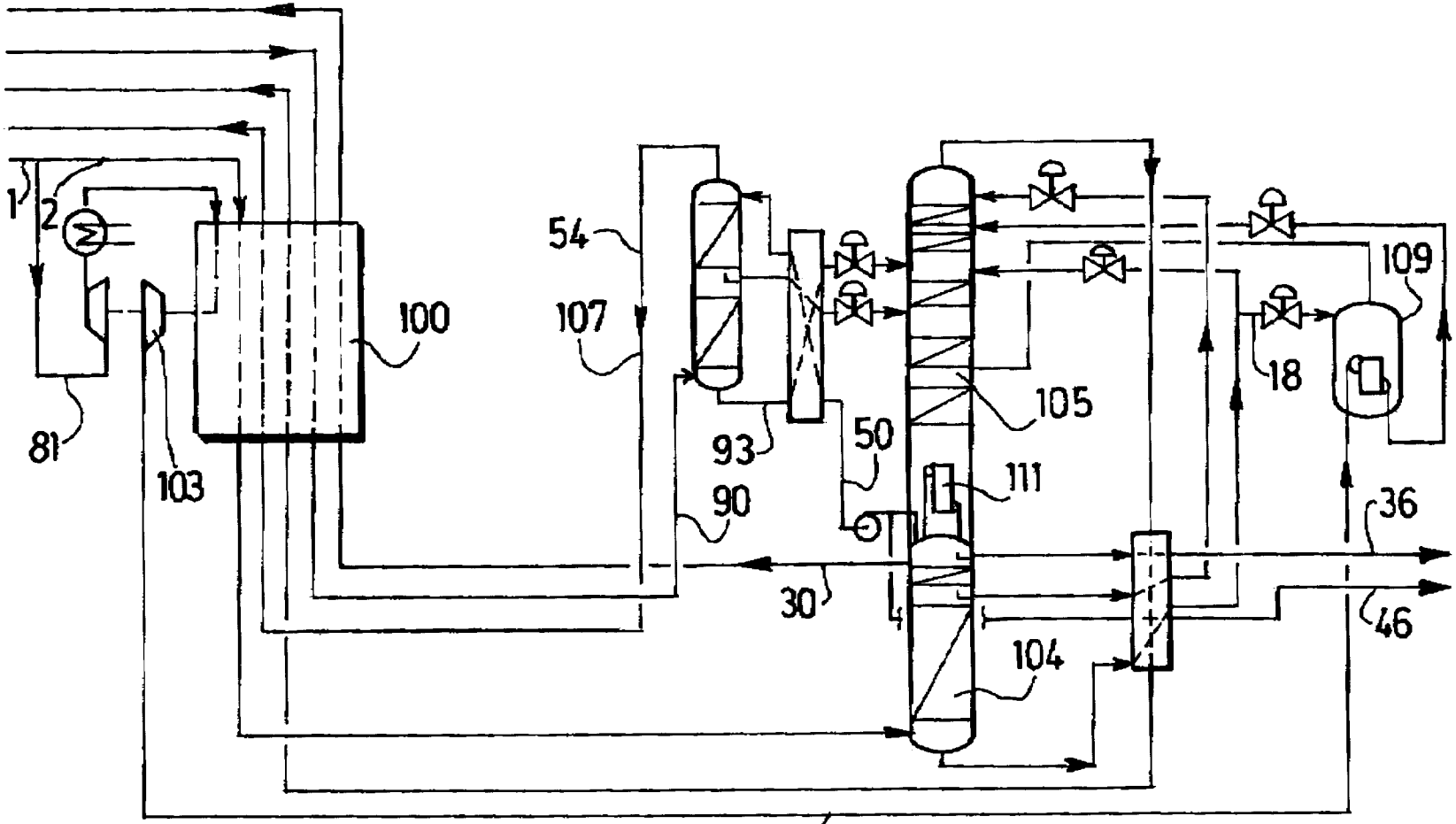
FIG. 2 is a diagram of an apparatus according to the invention.

FIG. 2 again shows the same columns and exchangers fed in the same way, except that all the air 86 from the blowing turbine is sent to the second reboiler/condenser 109 where it condenses against a portion of the rich liquid 18 which is at least partially vaporized therein. The liquefied air is expanded in a valve and sent to the low-pressure column a few trays above the point of injection of depleted liquid coming from the low-pressure column.

The rich liquid 18 sent to the second reboiler/condenser 109 constitutes 37% of the total stream of rich liquid and is vaporized in the latter in order thereafter to be sent to the low-pressure column a few theoretical trays above the first reboiler/condenser 111.

This allows 11,400 $Nm^3/h$ of medium-pressure nitrogen gas (MPNG) 30 to be withdrawn.

RESULTS OF THE APPLICATION OF THIS INVENTION TO A PLANT WITH A MIXING COLUMN

| | Basic plant (FIG. 1) | Addition of the reboiler/condenser 109 (FIG. 2) |
|---|---|---|
| Air input ($Nm^3/h$) | 274,700 | 274,700 |
| $O_2$ output ($Nm^3/h$) | 60,000 | 60,000 |
| $O_2$ purity (99% efficiency) | 95 mol % | 95 mol % |

-continued

| | Basic plant (FIG. 1) | Addition of the reboiler/condenser 109 (FIG. 2) |
|---|---|---|
| $O_2$ pressure (bar absolute) | 5 | 5 |
| MPNG output 30 ($Nm^3/h$) | 31000 | 11,400 |
| MPNG output/air input (%) | 1.1 | 4.1 |
| Energy saving | | +3.5% |

The apparatus may include an argon column or a column at a pressure intermediate between the medium and low pressures.

The refrigeration needed in the apparatus may be provided by a Claude turbine or a nitrogen turbine or by a combination of several turbines.

The low-pressure column may contain at least two reboiler/condensers, the bottom reboiler being fed, for example, with pressurized nitrogen.

The mixing column may operate at a pressure equal to, greater than or less than the medium pressure.

A nitrogen-rich or oxygen-rich liquid coming from the apparatus may be pressurized, for example by a pump, and vaporized in the exchanger 100 or another exchanger, for example by heat exchange with air, in order to deliver a pressurized gas product.

The low-pressure column may operate at a pressure of between 1.5 and 10 bar. To produce pressurized oxygen directly, the low-pressure column operates at between 4 and 10 bar.

A portion of the air from the blowing turbine may be sent to the mixing column.

The medium-pressure and low-pressure columns may be constructed so as to be side by side.

The process can be used to produce oxygen gas by withdrawing a stream of oxygen gas from the bottom of the low-pressure column. The gas warms up in the exchanger 100 and may optionally be compressed once it has warmed up.

What is claimed is:

1. Air separation apparatus comprising a column system comprising at least one double column comprising a medium-pressure column (104) and a low-pressure column (105) which are thermally linked to each other by a first reboiler/condenser (111) where the gas at the top of the medium-pressure column condenses, means for sending compressed and purified air to a heat exchanger (100) where it cools, means (2) for sending cooled air to the medium-pressure column in gas form, means for sending an oxygen-enriched fluid from the medium-pressure column to the low-pressure column where it is separated by cryogenic distillation, means for sending a nitrogen-enriched fluid from the medium-pressure column to the low-pressure column, means for withdrawing a nitrogen-rich fluid and an oxygen-rich fluid from the low-pressure column, a second reboiler/condenser (109), means (86) for sending air to the second reboiler/condenser where it condenses at least partially, and means for sending the at least partially condensed air to the low-pressure column, means (18) for sending a liquid from the low-pressure column or from the medium-pressure column or from another column (107) of the column system to the second reboiler/condenser, characterized in that the liquid (18) sent to the second reboiler/condenser contains between 22 and 70 mol % of oxygen and in that the at least partially condensed air sent to the column system comprises the only stream of liquefied air sent to the column system.

2. Apparatus according to claim 1, in which the at least partially condensed air sent to the low-pressure column (105) comprises the only stream of liquefied air sent to the column system.

3. Apparatus according to claim 1 which includes means (103) for expanding the air with production of work before sending it to the second reboiler/condenser (109).

4. Apparatus according to claim 1, which includes means for cooling the air to its dew point before sending it to the second reboiler/condenser (109).

5. Apparatus according to claim 1, which includes a mixing column (107) fed at the top with an oxygen-rich liquid (50) coming from the low-pressure column and fed at the bottom with a gas (90) more volatile than the oxygen-rich liquid.

6. Apparatus according to claim 1, which includes means for sending a portion of the liquid from the bottom of the medium-pressure column (104) directly to the low-pressure column (105) at a first level and another portion (18) of the liquid from the bottom of the medium-pressure column to the second reboiler/condenser (109).

7. Apparatus according to claim 6, in which the bottom liquid vaporizes in the second reboiler/condenser (109) and which includes means for sending the vaporized liquid to the low-pressure column at a level below the first level.

8. Apparatus according to claim 1, which includes means (30) for withdrawing a nitrogen-rich gas from the top of the medium-pressure column.

9. Apparatus according to claim 1, in which the low-pressure column does not have a top condenser.

10. Process for separating air by cryogenic distillation in an apparatus comprising at least one double column with a medium-pressure column (104) and a low-pressure column (105) which are thermally linked to each other by a first reboiler/condenser (111), in which process a stream of purified, compressed and cooled air (2) is sent to the medium-pressure column, in gas form, an oxygen-enriched fluid is sent from the medium-pressure column to the low-pressure column, where it is separated by cryogenic distillation, a nitrogen-enriched fluid is sent from the medium-pressure column to the low-pressure column, an oxygen-rich fluid and a nitrogen-rich fluid are withdrawn from the low-pressure column, a second stream of purified, compressed and cooled air (86) is sent to a second reboiler/condenser (109) where it condenses, at least partially, by heat exchange with a liquid (18) coming from at least one of the medium-pressure column, the low-pressure column and another column (107) of the column system and the at least partially condensed air is sent to the low-pressure column, characterized in that the liquid (18) sent to the second reboiler/condenser contains between 22 and 70 mol % oxygen, and the air liquefied in the second reboiler/condenser constitutes the only stream of liquefied air sent to the column system.

11. Process according to claim 10, in which the second stream is expanded in a turbine (103) before at least one portion thereof is sent to the second reboiler/condenser (109).

12. Process according to claim 10, in which an oxygen-rich liquid (50) is sent from the low-pressure column to the top of a mixing column (107) and a gas (90) more volatile than the oxygen-rich liquid is sent to the bottom of the mixing column (107).

13. Process according to claim 10, in which nitrogen (30) is sent to the top of the medium-pressure column (104).

14. Process according to claim 10, in which at least one of a liquid and a gas rich in oxygen is withdrawn from the bottom of the low-pressure column.

15. Process according to claim 10, in which the low-pressure column operates at between 1.5 and 10 bar absolute.

16. Process according to claim 15, wherein the low pressure column operates at between 3 and 10 bar absolute.

17. Process according to claim 10, in which the gas at the top of the low-pressure column (105) does not condense in a condenser.

18. Process according to claim 10, in which the liquid containing between 22 and 70 mol % of oxygen is not the liquid at the bottom of the low-pressure column (105).

19. Process according to claim 10, wherein the liquid sent to the second reboiler/condenser contains between 22 and 35 mol % oxygen.

* * * * *